US009679527B2

(12) United States Patent
Hwang et al.

(10) Patent No.: US 9,679,527 B2
(45) Date of Patent: Jun. 13, 2017

(54) DISPLAY DEVICE AND METHOD FOR DRIVING THE SAME

(71) Applicant: Samsung Display Co., LTD., Yongin, Gyeonggi-do (KR)

(72) Inventors: Yong-Sik Hwang, Yongin (KR); Yong-Soon Lee, Yongin (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 201 days.

(21) Appl. No.: 14/577,371

(22) Filed: Dec. 19, 2014

(65) Prior Publication Data

US 2015/0206502 A1 Jul. 23, 2015

(30) Foreign Application Priority Data

Jan. 20, 2014 (KR) ..... 10-2014-0006515

(51) Int. Cl.
*G09G 3/36* (2006.01)
*G09G 3/20* (2006.01)
*G09G 3/3225* (2016.01)

(52) U.S. Cl.
CPC ..... *G09G 3/3651* (2013.01); *G09G 3/3618* (2013.01); *G09G 3/2092* (2013.01); *G09G 3/3225* (2013.01); *G09G 2300/0495* (2013.01); *G09G 2310/0289* (2013.01); *G09G 2310/061* (2013.01); *G09G 2320/0276* (2013.01); *G09G 2330/022* (2013.01)

(58) Field of Classification Search
CPC ..... G09G 3/3618; G09G 2310/0289; G09G 2310/061–2310/063; G09G 2330/022
USPC ..... 345/55–111
See application file for complete search history.

(56) References Cited

U.S. PATENT DOCUMENTS 5,926,173 A * 7/1999 Moon ..... G09G 3/3611 345/211
2002/0060673 A1 5/2002 Noritake et al.
2004/0130543 A1 7/2004 Sun
2008/0001934 A1* 1/2008 Wyatt ..... G09G 3/3688 345/204

(Continued)

FOREIGN PATENT DOCUMENTS

KR 1998060015 A 10/1998
KR 100551735 A 2/2006
KR 1020070051662 A 5/2007

(Continued)

*Primary Examiner* — Michael Pervan
(74) *Attorney, Agent, or Firm* — Cantor Colburn LLP

(57) ABSTRACT

A display device includes a display panel including data lines and scan lines coupled, a data driver configured to supply data voltages to the data lines based on digital video data, a scan driver configured to supply scan signals to the scan lines, a timing controller configured to select one of a normal mode and a self-refresh mode based on a panel self-refresh enable signal, where the data and scan drivers are driven by a first frame frequency in the normal mode and by a second frame frequency lower than the first frame frequency in the self-refresh mode, and a power supply source configured to supply driving voltages to the data and scan drivers and the timing controller and to transmits a direct current power voltage to an outside thereof, where a transmission of the direct current power voltage is blocked during a blank period in the self-refresh mode.

19 Claims, 4 Drawing Sheets

(56) References Cited

U.S. PATENT DOCUMENTS

| | | | | |
|---|---|---|---|---|
| 2012/0133635 | A1* | 5/2012 | Ji | G09G 3/3688 345/212 |
| 2013/0215094 | A1* | 8/2013 | Choi | G09G 3/2025 345/211 |

FOREIGN PATENT DOCUMENTS

| | | | |
|---|---|---|---|
| KR | 100848961 | A | 7/2008 |
| KR | 100934975 | A | 12/2009 |
| KR | 1020110016632 | A | 2/2011 |

* cited by examiner

DISPLAY DEVICE AND METHOD FOR DRIVING THE SAME

This application claims priority to Korean Patent Application No. 10-2014-0006515, filed on Jan. 20, 2014, and all the benefits accruing therefrom under 35 U.S.C. §119, the content of which in its entirety is herein incorporated by reference.

BACKGROUND

1. Field

Exemplary embodiments of the invention relate to a display device and a method for driving the display device.

2. Description of the Related Art

With the development of information technology, the demand for various types of display device for displaying an image is increasing. A flat panel display, such as a liquid crystal display ("LCD"), a plasma display panel ("PDP"), and an organic light emitting diode ("OLED") display device, have been widely used in recent years.

The display device may include a display panel, a display driver and a power supply source. The display panel typically has a plurality of pixels for displaying an image. The display driver supplies driving signals to the display panel. The power supply source supplies power voltages to the display panel or the display driver. The display driver may include a data driver, a scan driver and a timing controller. The data driver has a source drive integrated circuit ("IC") that supplies data voltages to data lines to the display panel. The scan driver supplies scan signals to scan lines to the display panel. The timing controller controls operation timings of the data driver and the scan driver. Each pixel is coupled to a data line and a scan line through a transistor, thus each pixel receives a data voltage of the data line in response to a scan signal of the scan line. Each pixel represents a gray level according to the data voltage. Therefore, the display panel may display an image.

Recently, the display device is widely used for a portable display device such as a smart phone, a tablet, a notebook and so on. The portable display device typically uses a battery as a power supply source. Therefore, power consumption of the portable display device may be decreased to improve the convenience of using the portable display device.

SUMMARY

Exemplary embodiments of the invention relate to a display device and a method for driving the display device, which may decrease power consumption.

According to an exemplary embodiment of the invention, a display device includes a display panel including data lines, scan lines and a plurality of pixels coupled to the data lines and the scan lines; a data driver configured to supply data voltages to the data lines based on digital video data; a scan driver configured to supply scan signals to the scan lines; a timing controller configured to select one of a normal mode and a self-refresh mode based on a panel self-refresh enable signal, where the data driver and the scan driver are driven by a first frame frequency in the normal mode, and the data driver and the scan driver are driven by a second frame frequency, which is lower than the first frame frequency, in the self-refresh mode; and a power supply source configured to supply driving voltages to the data driver, the scan driver and the timing controller and to transmits a direct current power voltage to an outside thereof, where a transmission of the direct current power voltage from the power supply source is blocked during a blank period of a frame period in the self-refresh mode.

According to an exemplary embodiment of the invention, a method for driving a display device includes: supplying data voltages from a data driver of the display device to data lines of a display panel of the display device, based on digital video data; supplying scan signals from a scan driver of the display device to scan lines of the display panel; selecting one of a normal mode and a self-refresh mode based on a panel self-refresh enable signal, wherein the data driver and the scan driver are driven by a first frame frequency in the normal mode, and the data driver and the scan driver are driven by a second frame frequency, which is lower than the first frame frequency, in the self-refresh mode; supplying driving voltages from a power supply source of the display device to a timing controller, the data driver and the scan driver of the display device; and transmitting a direct current power voltage from the power supply source based on the selected one of the normal mode and the self-refresh mode, where the transmitting the direct current power voltage from the power supply source based on the selected one of the normal mode and the self-refresh mode includes blocking the transmitting the direct current power voltage from the power supply source during a blank period of a frame period in the self-refresh mode.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1A:
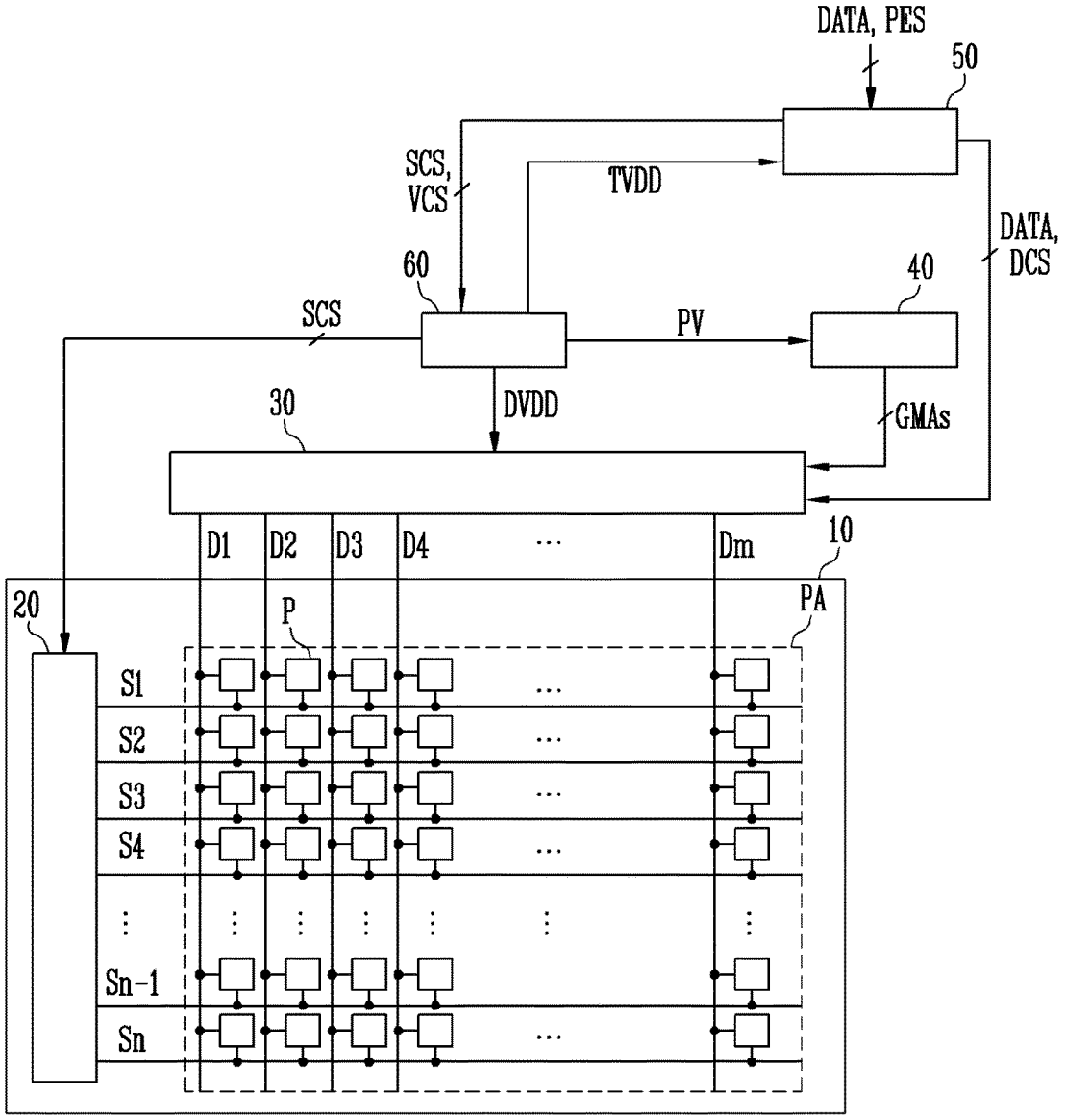
FIG. 1A is a block diagram showing an exemplary embodiment of a display device according to the invention.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Figure 1B:
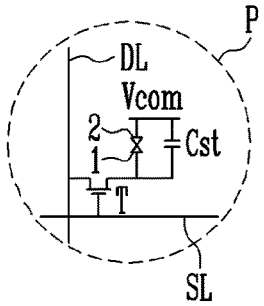
FIG. 1B is a circuit diagram showing an exemplary embodiment of a pixel of the display device shown in FIG. 1A.

FIG. 1A is a block diagram showing an exemplary embodiment of a display device according to the invention, and FIG. 1B is a circuit diagram showing an exemplary embodiment of a pixel of the display device shown in FIG. 1A. In an exemplary embodiment, the display device may be implemented as a flat panel display device, such as a liquid crystal display ("LCD"), a field emission display ("FED"), a plasma display panel ("PDP"), an organic light emitting diode ("OLED)" display device and the like. Hereinafter, exemplary embodiments where a flat panel display device is the LCD display will be described in detail, but the invention is not limited thereto. In an alternative exemplary embodiment, the display device may be one of other types of flat panel displays.

Referring to FIG. 1A, an exemplary embodiment of the display device according to the invention includes a display panel 10, a scan driver 20, a data driver 30, a gamma voltage supply unit 40, a timing controller 50, and a power supply source 60.

The display panel 10 includes an upper substrate, a lower substrate disposed opposite to the upper substrate, and a liquid crystal layer disposed between the upper substrate and the lower substrate. A pixel array PA may be disposed in the lower substrate. The pixel array PA includes a plurality of pixels P arranged substantially in a matrix form. In one exemplary embodiment, for example, the pixels P may be disposed in cell areas defined by the data lines D1 to Dm and the scan lines S1 to Sn.

In an exemplary embodiment, as shown in FIG. 1B, each pixel P is coupled to a data line DL and a scan line SL through a thin film transistor T. The thin film transistor T supplies a data voltage of the data line DL to a pixel electrode 1, in response to a scan signal of the scan line. Each pixel P drives liquid crystals of the liquid crystal layer by an electric field between the pixel electrode 1 and a common electrode 2, thus represents a gray level. A common voltage Vcom is supplied to the common electrode 2. Each pixel P includes a storage capacitor Cst for maintaining the voltage of the pixel electrode 1 for a predetermined period.

A black matrix, a color filter and the like may be disposed on an upper substrate of the display panel 10. The common electrode 2 is disposed on the upper substrate in an exemplary embodiment of the display panel in a vertical electric field driving method, such as a twisted nematic ("TN") mode a vertical alignment ("VA") mode, or an electrically controlled birefringence ("ECB") mode. The common electrode 2 may be disposed, together with the pixel electrode 1, on the lower substrate in an exemplary embodiment of the display panel in in a horizontal electric field driving method, such as an in-plane switching ("IPS") mode or a fringe field switching ("FFS") mode. In an exemplary embodiment, the liquid crystal mode of the display panel 10 may be implemented as any liquid crystal mode, as well as the TN mode, the VA mode, the ECB mode, the IPS mode and the FFS mode, described above.

An upper polarizing plate is attached to the upper substrate of the display panel 10, and a lower polarizing plate is attached to the lower substrate of the display panel 10. The light transmission axes of the upper and lower polarizing plates may be different from each other. In addition, alignment layers for setting a pre-tilt angle of liquid crystals are respectively disposed on the upper and lower substrates. A spacer for maintaining a cell gap of the liquid crystal layer is disposed between the upper and lower substrates of the display panel 10.

In an exemplary embodiment, the display device may further include a backlight unit (not shown) disposed under the liquid crystal display panel 10. The backlight unit emits light substantially uniformly to the liquid crystal display panel 10. The backlight unit may be implemented as a direct-type or edge-type backlight unit.

The scan driver 20 supplies scan signals to the scan lines S1 to Sn, based on scan timing control signals SCS. The scan driver 20 may supply the scan signals to the scan lines S1 to Sn. The scan driver 20 may include a shift register for sequentially outputting output signals, a level shifter for converting the output signals of the shift register to a swing width suitable for the thin film transistor T of each of the pixels P, an output buffer, and the like.

The scan driver 20 may be disposed on an outside of one side of the pixel array PA. Alternatively, the scan driver 20 may be disposed on outsides of both sides of the pixel array PA.

In an exemplary embodiment, the scan driver 20 may be disposed or mounted on a scan tape carrier package ("TCP"), and the scan TCP may be bonded to the lower substrate by a tape automated bonding ("TAB") process. Alternatively, the scan driver 20 may be bonded to the lower substrate by a chip-on-glass ("COG") process. Alternatively, the shift register of the scan driver 20 may be directly disposed on the lower substrate by a gate-in-panel ("GIP") process.

The data driver 30 may include a source drive integrated circuit ("IC"). The source drive IC receives digital video data DATA and data timing control signals DCS from the timing controller 50. The source drive IC receives gamma reference voltages GMAs from the gamma voltage supply unit 40.

The source drive IC may include a voltage divider to divide the gamma reference voltages GMAs, thus generates gamma compensation voltages. The source drive IC selects one of the gamma compensation voltages based on the digital video data DATA, and supply the selected gamma compensation voltage as a data voltage to a data line. The source drive IC supplies data voltages synchronized with each of the scan signals to the data lines D1 to Dm, based on the data timing control signals DCS. Therefore, data voltages may be supplied to pixels P, to which a scan signal is supplied.

In an exemplary embodiment, the source drive IC may be disposed or mounted on a source TCP, and the source TCP may be bonded to the lower substrate by the TAB process. Alternatively, the source drive IC may be bonded to the lower substrate by the COG process.

The gamma voltage supply unit 40 receives a power voltage PV from the power supply source 60. The power voltage PV may be direct current power voltages. The gamma voltage supply unit 40 may include voltage divider that divides the power voltage PV and a predetermined voltage, thus generates gamma compensation voltages. The predetermined voltage may be the common voltage or a ground voltage. The gamma voltage supply unit 40 supplies the gamma reference voltages GMAs to the data driver 30.

The timing controller 50 may receive the digital video data DATA and timing signals from an outside thereof, e.g., an external system board (not shown), through an interface such as a low voltage differential signaling ("LVDS") interface, a transition minimized differential signaling ("TMDS") interface. The timing controller 50 may receive timing signals such as a horizontal synchronization signal, a vertical synchronization signal, a data enable signal, a dot clock, and the like.

The timing controller 50 generates the scan driver control signals SCS for controlling an operation timing of the scan driver 20 and the data driver control signals DCS for controlling an operation timing of the data driver 30, based on the timing signals. The timing controller 50 supplies the scan driver control signals SCS to the scan driver 30. The timing controller 50 supplies the digital image data DATA and the data driver control signals DCS to the data driver 30.

In an exemplary embodiment, the timing controller 50 may receive a panel self-refresh ("PSR") enable signal PES from the external system board (not shown). The PSR enable signal PES has different logic levels, one of which may be selected based on whether an image of the digital video data DATA is a dynamic image or not. In one exemplary embodiment, for example, the PSR enable signal PES may have a first logic level voltage when the image of the digital video data DATA is the dynamic image, and a second logic level voltage, which is different from the first logic level voltage, when the image of the digital video data DATA is a static image.

The timing controller 50 controls operation timings of the scan driver 20 and the data driver 30 based on the PSR enable signal PES. The timing controller 50 may control the operation timings of the scan driver 20 and the data driver 30 in a normal mode when the PSR enable signal PES having the first logic level is input. In the normal mode, the timing controller 50 may control the operation timings of the scan driver 20 and the data driver 30 by a first frame frequency. The timing controller 50 may control the operation timings of the scan driver 20 and the data driver 30 in a panel self-refresh mode when the PSR enable signal PES having the second logic level is input. In the panel self-refresh mode, the timing controller 50 may control the operation timings of the scan driver 20 and the data driver 30 by a second frame frequency. The second frame frequency is lower than the first frame frequency.

When the static image is displayed in the display panel 10 during a plurality of frame periods, the digital video data DATA during the plurality of frame periods are substantially the same as each other. Therefore, the timing controller 50 stores the digital video data DATA in a memory in the panel self-refresh mode. Thus, the timing controller 50 does not need to receive the digital video data DATA from the external system board (not shown) in the panel self-refresh mode. The timing controller 50 supplies the digital video data DATA stored in the memory to the data driver.

The timing controller 50 supplies a power voltage supply control signal VCS to the power supply source 60. The power voltage supply control signal VCS has different logic levels, one of which may be selected based on whether the scan driver 20 and the data driver 30 operate in the normal mode or the panel self-refresh mode. In one exemplary embodiment, for example, the power voltage supply control signal VCS may have a third logic level voltage in the normal mode, and a fourth logic level voltage, which is different from the third logic level voltage, in the panel self-refresh mode.

The power supply source 60 may receive a power source voltage from a battery included in the display device or an external power source. The power supply source 60 generates driving voltages and direct current power voltages using the power source voltage. The power supply source 60 supplies the driving voltages and the direct current power voltages to the scan driver 20, the data driver 30 and the timing controller 50. The power supply source 60 may supply a data driving voltage DVDD to the data driver 30. The data driving voltage DVDD is a digital driving voltage for driving the data driver 30. The power supply source 60 may supply a timing driving voltage TVDD to the timing controller 50. The timing driving voltage TVDD is a digital driving voltage for driving the timing controller 50. The power supply source 60 may supply the common voltage Vcom to common lines coupled to the common electrodes.

The power supply source 60 receives the scan timing control signals SCS and the power voltage control signal VCS from the timing controller 50. The power supply source 60 may stop supplying (e.g., cut off) at least one (e.g., some) of the direct current power voltages supplied to the scan driver 20 and the data driver 30, based on the power voltage control signal VCS. In one exemplary embodiment, for example, the power supply source 60 does not block the direct current power voltages supplied to the scan driver 20 and the data driver 30 when the power voltage supply control signal VCS having the third logic level voltage is input, and the power supply source 60 blocks the direct current power voltages supplied to the scan driver 20 and the data driver 30 when the power voltage supply control signal VCS having the fourth logic level voltage is input.

As described above, in an exemplary embodiment, the operation timings of the scan driver 20 and the data driver 30 may be controlled by the first frame frequency based on the normal mode when the image of the digital video data DATA is the dynamic image. In an exemplary embodiment, the operation timings of the scan driver 20 and the data driver 30 may be controlled by the second frame frequency based on the panel self-refresh mode when an image of the digital video data DATA is the static image. In an exemplary embodiment, the direct current power voltages may be blocked from being supplied to the scan driver 20 and the data driver 30 in the panel self-refresh mode, such that power consumption may be reduced.

Figure 2:
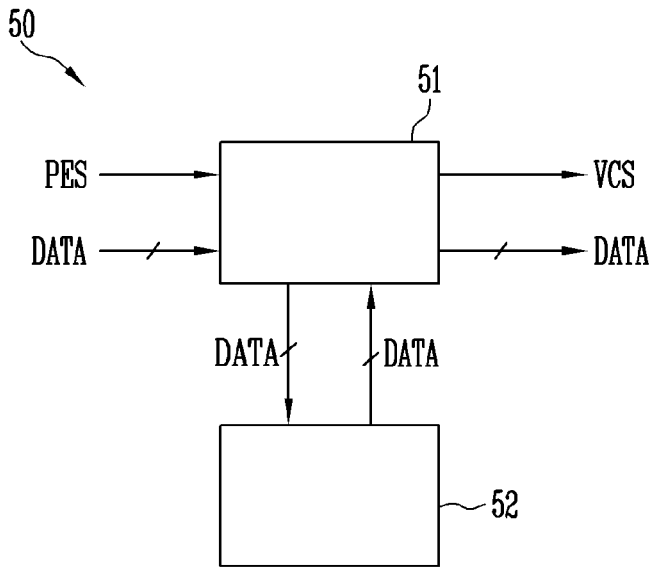
FIG. 2 is a block diagram showing an exemplary embodiment of a timing controller of FIG. 1A.
Figure 3:
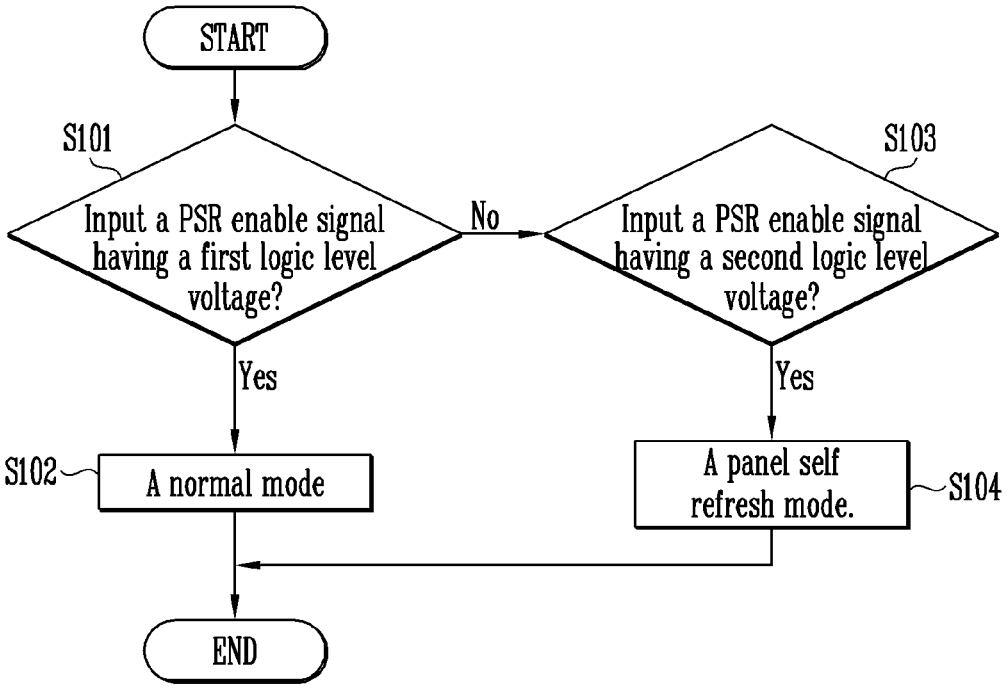
FIG. 3 is a flow chart illustrating an exemplary embodiment of a timing control method of the timing controller of FIG. 2.

FIG. 2 is a block diagram showing an exemplary embodiment of a timing controller of FIG. 1A. FIG. 3 is a flow chart illustrating an exemplary embodiment of a timing control method of the timing controller of FIG. 2.

Referring to FIG. 2, an exemplary embodiment of the timing controller 50 includes a main controller 51 and a memory 52. The main controller 51 receives the digital video data DATA, the timing signals and the PSR enable signal PES. The main controller 51 controls the operation timings of the scan driver 20 and the data driver 30 in one of the normal mode and the panel self-refresh mode. The memory 52 may include a frame memory that stores the digital video data DATA during one frame period.

Hereinafter, an exemplary embodiment of the timing control method of the timing controller 50 is described in detail with reference to FIGS. 2 and 3.

In an exemplary embodiment, the main controller 51 controls the operation timings of the scan driver 20 and the data driver 30 to be in the normal mode when the PSR enable signal having the first logic level voltage is input (S101 and S102).

Figure 4A:
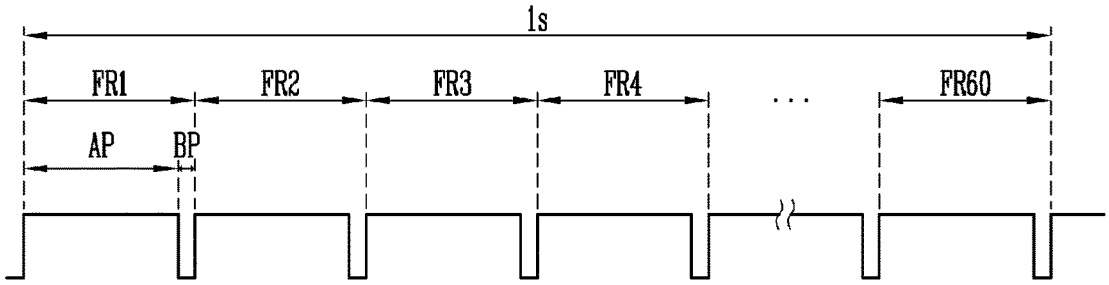
FIG. 4A is an exemplary diagram illustrating frame periods in a normal mode.

In the normal mode, the main controller 51 controls the operation timings of the scan driver 20 and the data driver 30 by the first frame frequency. The first frame frequency may be equal to or higher than 60 hertz (Hz). In one exemplary embodiment, for example, the first frame frequency may be 60 Hz. In such an embodiment, where the first frame frequency is 60 Hz, 60 frame periods FR1 to FR60 are defined in one second 1 s, as shown in FIG. 4A. In the normal mode, each of the frame periods FR1 to FR60 include an active period AP and a blank period BP. The blank period BP is a period between two adjacent active periods AP. In the blank period BP, the scan driver 20 does not supply the scan signals to the scan lines S1 to Sn and the data driver 30 does not supply the data voltages to the data lines D1 to Dm.

In the normal mode, the main controller 51 supplies the digital video data DATA from the external system board (not shown) to the data driver 30 during the active period AP of each of the frame periods FR1 to FR60. In the normal mode, the main controller 51 may selectively store the digital video data DATA in the memory 52.

The main controller 51 may include an inner memory (not shown). The inner memory may include a read-only memory ("ROM"). The inner memory may store data including information of the power voltage control signal VCS, the scan timing control signals SCS and the data timing control signals DCS.

In the normal mode, the main controller 51 may generate the power voltage control signal VCS having the third logic level voltage based on the data stored in the inner memory. In the normal mode, the main controller 51 supply the power voltage control signal VCS having the third logic level voltage to the power supply source 60.

In the normal mode, the main controller 51 may generate the scan timing control signals SCS and the data timing control signal DCS based on the timing signals and the data stored in the inner memory. In the normal mode, the main controller 51 supply the scan timing control signals SCS to the scan driver 20 and the data timing control signals DCS to the data driver 30. The scan timing control signals SCS and the data timing control signals DCS are not shown in FIG. 2 for convenience of illustration.

In the normal mode, the scan driver 20 supplies the scan signals to the scan lines S1 to Sn during the active period AP of each of the frame periods FR1 to FR60, based on the scan timing control signals SCS. In the normal mode, the scan driver 20 does not supply the scan signals to the scan lines S1 to Sn during the blank period BP of each of the frame periods FR1 to FR60.

In the normal mode, the power supply source 60 supply the direct current power voltages PV to the gamma voltage supply unit 40 in response to the power voltage control signal VCS having the third logic level voltage. Therefore, in the normal mode, the gamma voltage supply unit 40 supplies the gamma reference voltages GMAs to the data driver 30.

In the normal mode, the data driver 30 supplies the data voltages to the data lines D1 to Dm during the active period AP of each of the frame periods FR1 to FR60, based on the digital video data DATA, the data timing control signals DCS and the gamma reference voltages GMAs. In the normal mode, the digital video data DATA may not be input to the data driver 30 during the blank period BP of each of the frame periods FR1 to FR60 such that the data driver 30 may not supply the data voltages to the data lines D1 to Dm during the blank period BP.

In such an embodiment, the main controller 51 controls the operation timings of the scan driver 20 and the data driver 30 to be in the panel self-refresh mode when the PSR enable signal having the second logic level voltage is input (S103 and S104).

Figure 4B:
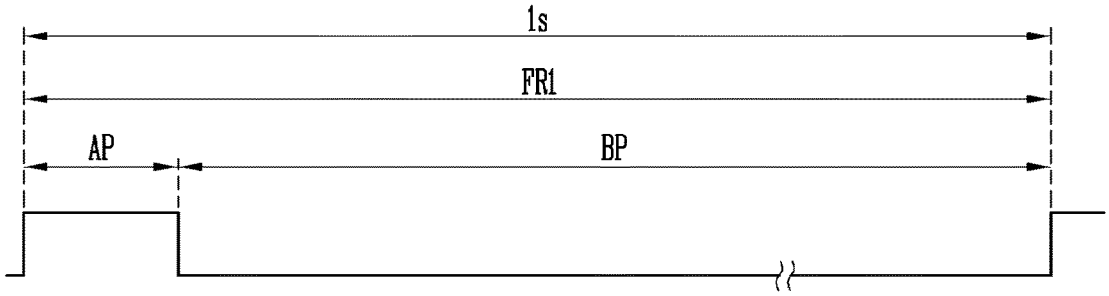
FIG. 4B is an exemplary diagram illustrating frame periods in a panel self-refresh mode.

In the panel self-refresh mode, the main controller 51 controls the operation timings of the scan driver 20 and the data driver 30 by the second frame frequency. The second frame frequency may be lower than 60 Hz. In one exemplary embodiment, for example, the second frame frequency may be 1 Hz. In such an embodiment, where the second frame frequency is 1 Hz, one frame period FR1 is defined in one second 1 s, as shown in FIG. 4B. In the panel self-refresh mode, the frame period FR1 include an active period AP and a blank period BP.

The active period AP of a frame period in the self-refresh mode is substantially the same as the active period AP of a frame period in the normal mode. However, the blank period BP of a frame period in the self-refresh mode is longer than the blank period BP of a frame period in the normal mode. Accordingly, a frame period in the self-refresh mode is longer than a frame period in the normal mode.

In the panel self-refresh mode, the main controller 51 stores the digital video data DATA in the memory 52. In the panel self-refresh mode, the main controller 51 supplies the digital video data DATA stored in the memory 52 to the data driver 30 during the active period AP of the frame period FR1.

In an exemplary embodiment, as described above, the main controller 51 may include an inner memory (not shown). The inner memory may store data including information of the power voltage control signal VCS, the scan timing control signals SCS and the data timing control signals DCS.

In the panel self-refresh mode, the main controller 51 may generate the power voltage control signal VCS based on the data stored in the inner memory. In the panel self-refresh mode, the main controller 51 supply the power voltage control signal VCS having the third logic level voltage to the power supply source 60 during the active period AP of the frame period FR1. In the panel self-refresh mode, the main controller 51 supply the power voltage control signal VCS having the fourth logic level voltage to the power supply source 60 during the blank period BP of the frame period FR1.

In the panel self-refresh mode, the main controller 51 may generate the scan timing control signals SCS and the data timing control signal DCS based on the timing signals and the data stored in the inner memory. In the panel self-refresh mode, the main controller 51 supplies the scan timing control signals SCS to the scan driver 20 and the data timing control signals DCS to the data driver 30. The scan timing control signals SCS and the data timing control signals DCS are omitted in FIG. 2.

In the panel self-refresh mode, the scan driver 20 supplies the scan signals to the scan lines S1 to Sn during the active period AP of the frame period FR1, based on the scan timing control signals SCS. In the panel self-refresh mode, the scan driver 20 does not supply the scan signals to the scan lines S1 to Sn during the blank period BP of the frame period FR1.

In the panel self-refresh mode, the power supply source 60 supply the direct current power voltages PV to the gamma voltage supply unit 40 in response to the power voltage control signal VCS having the third logic level voltage during the active period AP of the frame period FR1. Therefore, in the panel self-refresh mode, the gamma voltage supply unit 40 supplies the gamma reference voltages GMAs to the data driver 30 during the active period AP of the frame period FR1. In the panel self-refresh mode, the power supply source 60 does not supply the direct current power voltages PV to the gamma voltage supply unit 40 in response to the power voltage control signal VCS having the fourth logic level voltage during the blank period BP of the frame period FR1. Therefore, in the panel self-refresh mode, the gamma voltage supply unit 40 does not supply the gamma reference voltages GMAs to the data driver 30 during the blank period BP of the frame period FR1.

In the panel self-refresh mode, the data driver 30 supplies the data voltages to the data lines D1 to Dm during the active period AP of the frame period FR1, based on the digital video data DATA, the data timing control signals DCS and the gamma reference voltages GMAs. In the panel self-refresh mode, the data driver 30 does not supply the data voltages to the data lines D1 to Dm during the blank period BP of the frame period FR1 because the digital video data DATA and the gamma reference voltages GMAs are not input.

As described above, in an exemplary embodiment, the blank period BP is longer than the active period AP in the panel self-refresh mode, and the direct current power voltage PV are not applied to the gamma voltage supply unit 40 during the blank period BP in the panel self-refresh mode, during which the data driver 30 does not supply the data voltages to the data lines D1 to Dm, such that power consumption during the blank period BP in the panel self-refresh mode is substantially reduced.

Figure 5:
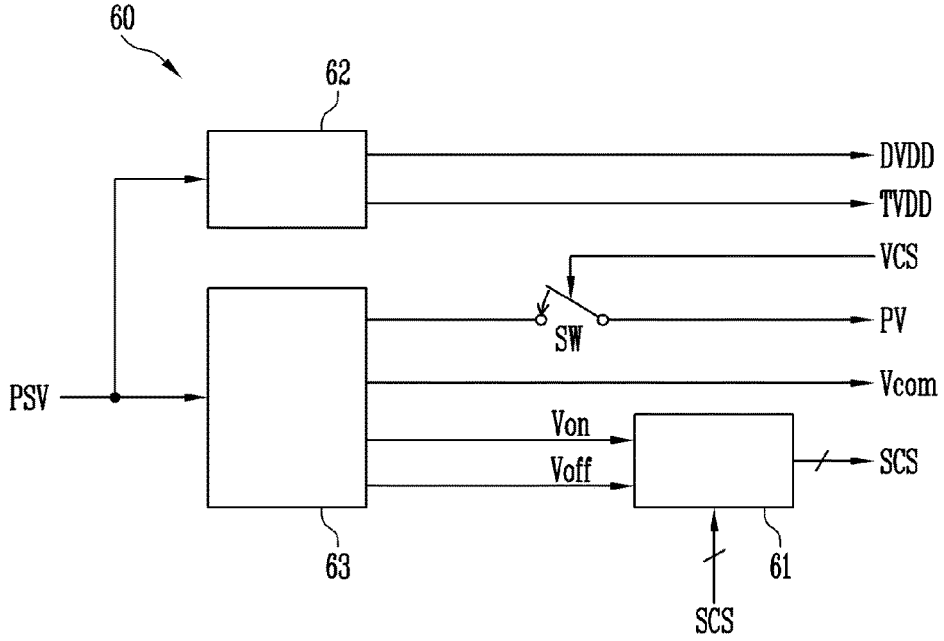
FIG. 5 is a block diagram showing an exemplary embodiment of a power supply source according to the invention.

FIG. 5 is a block diagram showing an exemplary embodiment of a power supply source according to the invention. Referring to FIG. 5, an exemplary embodiment of the power supply source 60 includes a level shifter 61, a driving voltage supply unit 62, a power voltage supply unit 63, a switch SW and the like.

The driving voltage supply unit 62 receives a power source voltage PSV from a battery included in the display device or an external power source. The driving voltage supply unit 62 generates a data driving voltage DVDD and a timing driving voltage TVDD using the power source voltage PSV. The data driving voltage DVDD is a digital driving voltage for driving the data driver 30. The timing driving voltage TVDD is a digital driving voltage for driving the timing controller 50. The driving voltage supply unit 62 supplies the data driving voltage DVDD to the data driver 30 and supplies the timing driving voltage TVDD to the timing controller 50.

The power voltage supply unit 63 receives the power source voltage PSV from the battery included in the display device or the external power source. The power voltage supply unit 63 generates a common voltage Vcom, a power voltage PV (e.g., a single power voltage), a gate-on voltage Von, a gate-off voltage Voff and the like. The common voltage Vcom refers to a voltage supplied to common lines of the display panel 10 coupled to common electrodes. The power voltage PV refers to a voltage supplied to the gamma voltage supply unit 40. The gate-on voltage Von refers to a turn-on voltage that turns on a thin film transistor of each pixel of the display panel. The gate-off voltage Voff refers to a turn-off voltage that turns off the thin film transistor of each pixel.

The power voltage supply unit 63 supplies the common voltage Vcom to the common lines of the display panel 10. In such an embodiment, the power voltage supply unit 63 supplies the gate-on voltage Von and the gate-off voltage Voff to the level shifter 61. The power voltage supply unit 63 supplies the power voltage PV to the gamma voltage supply unit 40 through the switch SW. In an exemplary embodiment, as shown in FIG. 5, the power supply source 60 may include a single switch SW and a single power voltage PV may be supplied to the gamma voltage supply unit 40, but the invention is not limited thereto. In one alternative exemplary embodiment, for example, the power voltage supply unit 63 may supply a plurality of power voltages PV to the gamma voltage supply unit 40 through a plurality of switches SW.

The level shifter 61 receives the scan timing control signal SCS from the timing controller 50, and the gate-on voltage Von and the gate-off voltage Voff to the power voltage supply unit 63. The level shifter 61 converts a swing width of the scan timing control signals SCS from the gate-off voltage Voff to the gate-on voltage Von, and then supplies the scan timing controls signals SCS to the scan driver 20.

The switch SW is turned on in response to the power voltage supply control signal VCS having the third logic level voltage, such that the power voltage PV from the power voltage supply unit 63 is supplied to the gamma voltage supply unit 40. The switch SW is turned off in response to the power voltage supply control signal VCS having the fourth logic level voltage, such that the power voltage PV from the power voltage supply unit 63 is not supplied to the gamma voltage supply unit 40. In such an embodiment, the switch SW controls a transmission of the power voltage PV from the power voltage supply unit 63 to the gamma voltage supply unit 40 in response to the power voltage supply control signal VCS having the fourth logic level voltage. In an alternative exemplary embodiment, a transmission of another voltage from the power voltage supply unit 63, e.g., the common voltage Vcom, the gate-on and gate-off voltages Von and Voff, the data driving voltage DVDD or the timing driving voltage TVDD, may be controlled by a switch SW based on the power voltage supply control signal VCS.

As described above, in an exemplary embodiment, transmission of the power voltage PV from the power voltage supply unit 63 to the gamma voltage supply unit 40 is controlled such that the power supply source 60 does not supply the power voltage PV to the gamma voltage supply unit 40 during the blank period BP in the panel self-refresh mode. Therefore, in such an embodiment, power consumption during the blank period BP in the panel self-refresh mode may be reduced.

Figure 6:
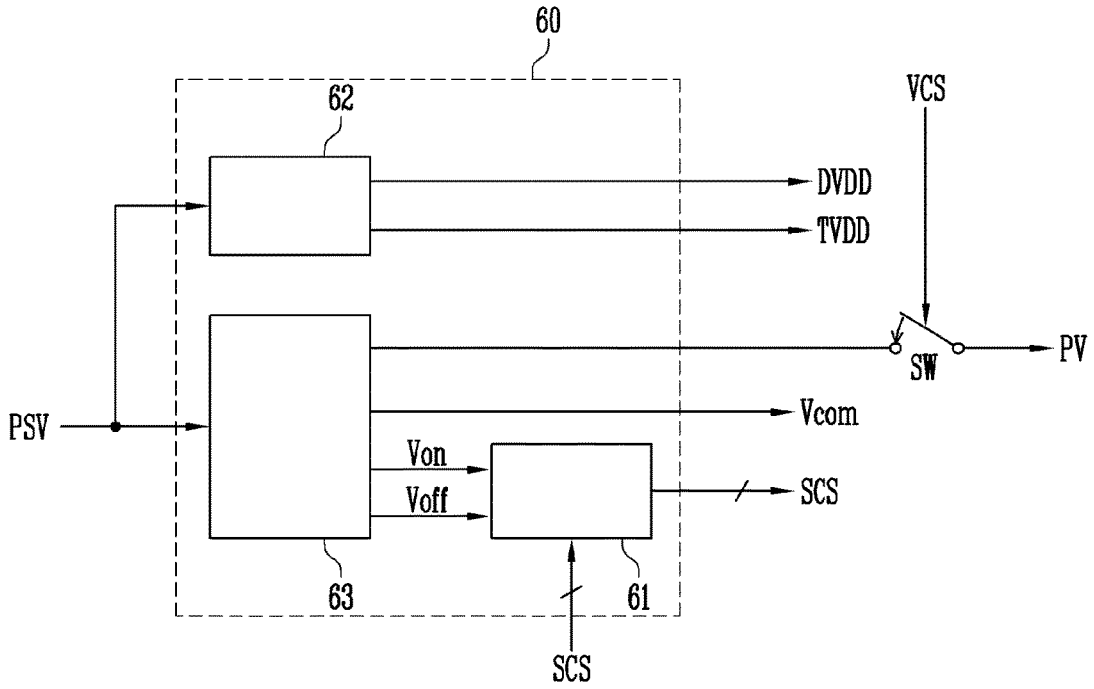
FIG. 6 is a block diagram showing an alternative exemplary embodiment of a power supply source according to the invention.

FIG. 6 is a block diagram showing an alternative exemplary embodiment of a power supply source according to the invention. Referring to FIG. 6, in an alternative exemplary embodiment, the power supply source 60 includes a level shifter 61, a driving voltage supply unit 62, a power voltage supply unit 63, and the like.

In an exemplary embodiment, as shown in FIG. 6, the power supply source 60 may not include the switch SW that controls a transmission of the power voltage PV from the power voltage supply unit 63 to the gamma voltage supply unit 40 based on the power voltage supply control signal VCS. In one exemplary embodiment, for example, the gamma voltage supply unit 40 may include the switch SW.

The level shifter 61, the driving voltage supply unit 62, the power voltage supply unit 63 and the switch SW shown in FIG. 6 are substantially the same as the level shifter 61, the driving voltage supply unit 62, the power voltage supply unit 63 and the switch SW of the power supply source shown in FIG. 5, and any repetitive detailed description thereof will be omitted.

Figure 7:
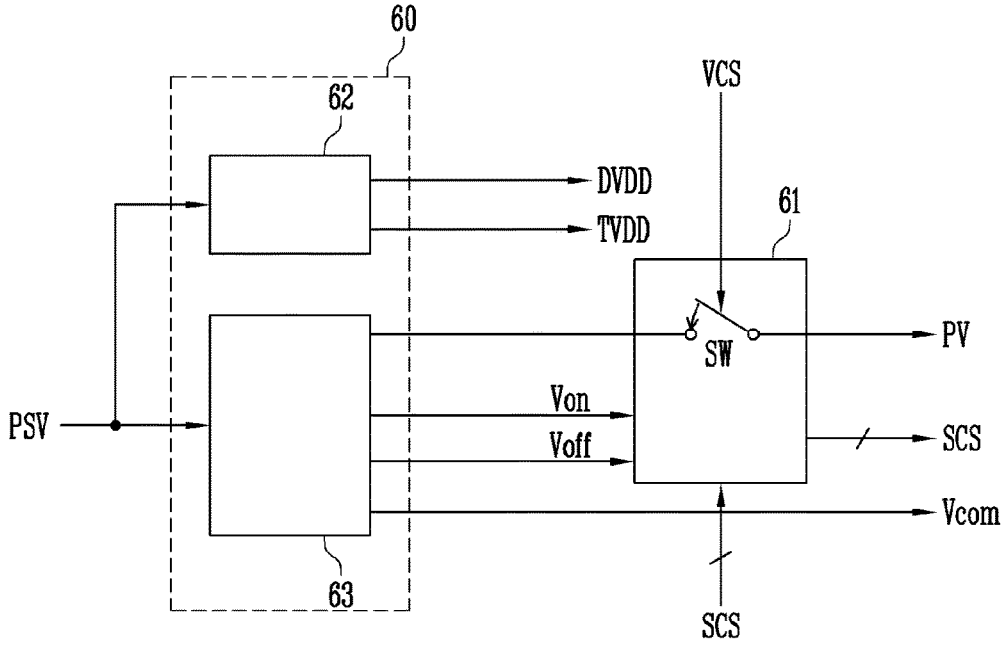
FIG. 7 is a block diagram showing another alternative exemplary embodiment of a power supply source according to the invention.

FIG. 7 is a block diagram showing another alternative exemplary embodiment of a power supply source according to the invention. Referring to FIG. 7, another alternative exemplary embodiment of the power supply source 60 includes a driving voltage supply unit 62, a power voltage supply unit 63, and the like.

In an exemplary embodiment, as shown in FIG. 7, the power supply source 60 may not include the level shifter 61 and the switch SW. In such an embodiment, the level shifter 61 may be disposed between the power supply source 60 and the scan driver 20, and the level shifter 61 may include the switch SW.

The level shifter 61, the driving voltage supply unit 62, the power voltage supply unit 63 and the switch SW shown in FIG. 7 are substantially the same as the level shifter 61, the driving voltage supply unit 62, the power voltage supply unit 63 and the switch SW shown in FIG. 5, and any repetitive detailed description thereof will be omitted.

As described herein, in exemplary embodiments of the invention, the blank period BP is longer than the active period AP in the panel self-refresh mode, and the direct current power voltages PV are not supplied to the gamma voltage supply unit 40 during the blank period BP in the panel self-refresh mode because the data driver 30 does not supply the data voltages to the data lines D1 to Dm during the blank period BP. Accordingly, in such embodiments, power consumption during the blank period BP in the panel self-refresh mode may be substantially reduced.

Exemplary embodiments of the invention have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention as set forth in the following claims.

What is claimed is:

1. A display device comprising:

a display panel comprising data lines, scan lines and a plurality of pixels coupled to the data lines and the scan lines;

a data driver configured to supply data voltages to the data lines based on digital video data;

a scan driver configured to supply scan signals to the scan lines;

a timing controller configured to select one of a normal mode and a self-refresh mode based on a panel self-refresh enable signal, wherein the data driver and the scan driver are driven by a first frame frequency in the normal mode, and the data driver and the scan driver are driven by a second frame frequency, which is lower than the first frame frequency, in the self-refresh mode; and a power supply source configured to supply driving voltages to the data driver, the scan driver and the timing controller and to transmit a direct current power voltage to an outside thereof, wherein the timing controller generates a power voltage supply control signal based on the panel self-refresh enable signal and supplies the power voltage supply control signal to the power supply source, wherein the power voltage supply control signal has a first logic level voltage in the normal mode and a second logic level voltage different from the first logic level voltage in the self-refresh mode, the power supply source transmits the direct current power voltage in response to the power supply control signal having the first logic level voltage, and a transmission of the direct current power voltage from the power supply source is blocked in response to the power supply control signal having the second logic level voltage during a blank period of a frame period.

2. The display device of claim 1, wherein the frame period comprises the blank period, and an active period in which the scan signals are supplied.

3. The display device of claim 2, wherein the timing controller supplies digital video data stored in a memory thereof to the data driver in the panel self-refresh mode.

4. The display device of claim 3, wherein the timing controller supplies digital video data received from an outside thereof to the data driver in the normal mode.

5. The display device of claim 4, wherein the active period of one frame period in the self-refresh mode is substantially the same as the active period of one frame period in the normal mode.

6. The display device of claim 5, wherein the blank period of the one frame period in the self-refresh mode is longer than the blank period of the one frame period in the normal mode.

7. The display device of claim 6, wherein the one frame period in the self-refresh mode is longer than the one frame period in the normal mode.

8. The display device of claim 1, further comprising:

a gamma voltage supply unit configured to receive the direct current power voltage from the power supply source and to supply gamma reference voltages to the data driver based on the direct current power voltage, wherein the gamma voltage supply unit comprises a voltage divider which divides the direct current power voltage to generate the gamma reference voltages.

9. The display device of claim 8, wherein the power supply source comprises a switch which controls the transmission of the direct current power voltage therefrom to the gamma voltage supply unit based on the power voltage supply control signal.

10. The display device of claim 8, wherein the gamma voltage supply unit comprises a switch which controls the transmission of the direct current power voltage from the power supply source based on the power voltage supply control signal.

11. The display device of claim 1, further comprising:

a level shifter configured to covert a swing width of each of scan timing control signals supplied from the timing controller to the scan driver, wherein the level shifter comprises a switch which controls the transmission of the direct current power voltage from the power supply source to the gamma voltage supply unit based on the power voltage supply control signal.

12. A method for driving a display device, the method comprising:

supplying data voltages from a data driver of the display device to data lines of a display panel of the display device, based on digital video data;

supplying scan signals from a scan driver of the display device to scan lines of the display panel;

selecting one of a normal mode and a self-refresh mode based on a panel self-refresh enable signal, wherein the data driver and the scan driver are driven by a first frame frequency in the normal mode, and the data driver and the scan driver are driven by a second frame frequency, which is lower than the first frame frequency, in the self-refresh mode;

supplying driving voltages from a power supply source of the display device to a timing controller, the data driver and the scan driver of the display device;

generating a power voltage supply control signal based on the panel self-refresh enable signal to have a first logic level voltage in the normal mode and a second logic level voltage different from the first logic level voltage in the self-refresh mode, and supplying the power voltage supply control signal to the power supply source; and transmitting a direct current power voltage from the power supply source based on the power voltage supply control signal, wherein the transmitting the direct current power voltage from the power supply source based on the power voltage supply control signal comprises:

transmitting the direct current power voltage from the power supply source in response to the power supply control signal having the first logic level voltage; and blocking the transmitting the direct current power voltage from the power supply source in response to the power supply control signal having the second logic level voltage during a blank period of a frame period.

13. The method of claim 12, wherein the frame period comprises the blank period, and an active period in which the scan signals are supplied.

14. The method of claim 13, further comprising:

controlling operation timings of the data driver and the scan driver using the timing controller based on the selected one of the normal mode and the self-refresh mode, which comprises supplying digital video data stored in a memory of the timing controller to the data driver in the panel self-refresh mode.

15. The method of claim 14, wherein the controlling the operation timings of the data driver and the scan driver using the timing controller based on the selected one of the normal mode and the self-refresh mode further comprises supplying digital video data from an outside of timing controller to the data driver in the normal mode.

16. The method of claim 15, wherein the active period of one frame period in the self-refresh mode is substantially the same as the active period of one frame period in the normal mode.

17. The method of claim 16, wherein the blank period of the one frame period in the self-refresh mode is longer than the blank period of the one frame period in the normal mode.

18. The method of claim 17, wherein the one frame period in the self-refresh mode is longer than the one frame period in the normal mode.

19. A display device comprising:

a display panel comprising data lines, scan lines and a plurality of pixels coupled to the data lines and the scan lines;

a data driver which supplies data voltages to the data lines based on digital video data;

a scan driver which supplies scan signals to the scan lines;

a timing controller which selects one of a normal mode and a self-refresh mode based on a panel self-refresh enable signal, wherein the data driver and the scan driver are driven by a first frame frequency in the normal mode when the panel self-refresh enable signal has a first logic level voltage, and the data driver and the scan driver are driven by a second frame frequency, which is lower than the first frame frequency, in the self-refresh mode when the panel self-refresh enable signal has a second logic level voltage different from the first logic level voltage; and a power supply source which supplies driving voltages to the data driver, the scan driver and the timing controller and transmits a direct current power voltage to an outside thereof, wherein the timing controller generates a power voltage supply control signal based on the panel self-refresh enable signal and supplies the power voltage supply control signal to the power supply source, wherein the power voltage supply control signal has a third logic level voltage and a fourth logic level voltage different from the third logic level voltage, the power voltage supply control signal has the third logic level voltage during an active period and a blank period of a frame period when the panel self-refresh enable signal has the first logic level voltage, the power voltage supply control signal has the third logic level voltage during the active period and has the fourth logic level voltage during the blank period when the panel self-refresh enable signal has the second logic level voltage, the power supply source transmits the direct current power voltage in response to the power supply control signal having the first logic level voltage, and a transmission of the direct current power voltage from the power supply source is blocked in response to the power supply control signal having the second logic level voltage.

* * * * *